US006581937B1

(12) United States Patent
Crisswell

(10) Patent No.: US 6,581,937 B1
(45) Date of Patent: Jun. 24, 2003

(54) MATHEMATICAL GAME APPARATUS AND METHOD OF PLAYING THE SAME

(76) Inventor: Kenneth B. Crisswell, P.O. Box 15245, Panorama 7506 (ZA)

( * ) Notice: Subject to any disclaimer, the term of this patent is extended or adjusted under 35 U.S.C. 154(b) by 0 days.

(21) Appl. No.: 10/014,210

(22) Filed: Nov. 9, 2001

(51) Int. Cl.[7] ..... A63F 3/00

(52) U.S. Cl. ..... 273/299; 273/272

(58) Field of Search ..... 434/188, 208, 434/209; 273/272, 299

(56) References Cited

U.S. PATENT DOCUMENTS

| | | | | | |
|---|---|---|---|---|---|
| 1,584,062 | A | | 5/1926 | Williamson | |
| 3,396,972 | A | * | 8/1968 | Smith | 273/272 |
| 3,904,207 | A | * | 9/1975 | Gold | 264/71 |
| 4,306,724 | A | * | 12/1981 | Brzezinski et al. | 273/243 |
| 5,033,754 | A | | 7/1991 | Finch | |
| 5,054,788 | A | * | 10/1991 | Kirby | 273/272 |
| D351,624 | S | | 10/1994 | Vasquez | |
| 5,551,700 | A | | 9/1996 | Druce et al. | |
| 5,603,501 | A | | 2/1997 | Hayes | |
| 5,615,886 | A | * | 4/1997 | Chalfin et al. | 273/272 |
| 5,639,091 | A | | 6/1997 | Morales | |

* cited by examiner

*Primary Examiner*—William M. Pierce

(57) ABSTRACT

A game board apparatus and method of playing a game for improving mathematical skills that includes a game board having a top surface. The top surface has indicia forming a grid thereon and the grid includes a plurality of boxes for positioning one of a plurality of game pieces thereon. The plurality of boxes further includes blank boxes, symbol boxes, chance boxes and bonus boxes. The apparatus also includes a plurality of game tiles comprising number tiles, symbol tiles, and joker tiles and blank tiles. The number tiles have the digits 0 through 9 marked thereon, the symbol tiles have arithmetic symbols marked thereon, and the joker tiles have the word "joker" marked thereon so that the are for representing any symbol or number indicated by a player. The apparatus further includes a plurality of chance cards for use when a player moves a game tile onto a chance box. The chance cards have point and explanation indicia.

The method of playing the game to improve mathematical skills includes selecting a color of tiles by each of the players for identifying each tile placed on the game board by each different player. Then, the method includes dispensing a plurality of sets of game tiles to each player. The method further includes starting the game with each player having a preliminary score of 150 points. Further, the method includes placing a series of tiles by a first one of the players on the game board in an order forming an equation of whole numbers from the plurality of sets of game tiles on the top surface of the board. The equation is formed of whole numbers from 1 through 99 and is formed of less than twelve tiles. Further, the equation includes at least two symbol tiles with one of the symbol tiles having the "=" symbol indicated thereon. Also, the equation is formed along either a horizontal axis or a vertical axis of the game board.

20 Claims, 4 Drawing Sheets

| Calculator Battery Flat | Cell Phone Rings | Guilty of Fraud Charge | Failed Arithmetic Test | Pen Not Working |
|---|---|---|---|---|
| +50 points | +60 points | +60 points | +60 points | +50 points |

| Calculator Charged | Cell Phone Off | Not Guilty of Fraud Charge | Passed Arithmetic Test | Pen Working |
|---|---|---|---|---|
| −50 points | −60 points | −60 points | −60 points | −50 points |

28

| Calculator Battery Flat | Cell Phone Rings | Guilty of Fraud Charge | Failed Arithmetic Test | Pen Not Working |
|---|---|---|---|---|
| +50 points | +60 points | +60 points | +60 points | +50 points |
| Calculator Charged | Cell Phone Off | Not Guilty of Fraud Charge | Passed Arithmetic Test | Pen Working |
| −50 points | −60 points | −60 points | −60 points | −50 points |

28

MATHEMATICAL GAME APPARATUS AND METHOD OF PLAYING THE SAME

BACKGROUND OF THE INVENTION

1. Field of the Invention

The present invention relates to mathematical skills games and more particularly pertains to a new mathematical game apparatus and method of playing the same for developing mathematical acuity.

2. Description of the Prior Art

The use of mathematical skills games is known in the prior art. More specifically, mathematical skills games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes Morales, U.S. Pat. No. 5.639,091; Williamson, U.S. Pat. No. 1,584,062; Hayes, U.S. Pat. No. 5,603,501; Druce et al., U.S. Pat. No. 5,551,700; Finch, U.S. Pat. No. 5,033,754; and Vasquez U.S. Pat. No. Des. 351,624.

While these devices fulfill their respective, particular objectives and requirements, the aforementioned patents do not disclose a new mathematical game apparatus and method of playing the same. The inventive device includes a game board apparatus and method of playing a game for improving mathematical skills that includes a game board having a top surface. The top surface has indicia forming a grid thereon and the grid includes a plurality of boxes for positioning one of a plurality of game pieces thereon. The plurality of boxes further includes blank boxes, symbol boxes, chance boxes and bonus boxes. The apparatus also includes a plurality of game tiles comprising number tiles, symbol tiles, and joker tiles and blank tiles. The number tiles have the digits 0 through 9 marked thereon, the symbol tiles have arithmetic symbols marked thereon, and the joker tiles have the word "joker" marked thereon so that the are for representing any symbol or number indicated by a player. The apparatus further includes a plurality of chance cards for use when a player moves a game tile onto a chance box. The chance cards have point and explanation indicia.

The method of playing the game to improve mathematical skills includes selecting a color of tiles by each of the players for identifying each tile placed on the game board by each different player. Then, the method includes dispensing a plurality of sets of game tiles to each player. The method further includes starting the game with each player having a preliminary score of 150 points. Further, the method includes placing a series of tiles by a first one of the players on the game board in an order forming an equation of whole numbers from the plurality of sets of game tiles on the top surface of the board. The equation is formed of whole numbers from 1 through 99 and is formed of less than twelve tiles. Further, the equation includes at least two symbol tiles with one of the symbol tiles having the "=" symbol indicated thereon. Also, the equation is formed along either a horizontal axis or a vertical axis of the game board.

In these respects, the mathematical game apparatus and method of playing the same according to the present invention substantially departs from the conventional concepts and designs of the prior art, and in so doing provides an apparatus primarily developed for the purpose of developing mathematical acuity.

SUMMARY OF THE INVENTION

In view of the foregoing disadvantages inherent in the known types of mathematical skills games now present in the prior art, the present invention provides a new mathematical game apparatus and method of playing the same construction wherein the same can be utilized for developing mathematical acuity.

The general purpose of the present invention, which will be described subsequently in greater detail, is to provide a new mathematical game apparatus and method of playing the same apparatus and method which has many of the advantages of the mathematical skills games mentioned heretofore and many novel features that result in a new mathematical game apparatus and method of playing the same which is not anticipated, rendered obvious, suggested, or even implied by any of the prior art mathematical skills games, either alone or in any combination thereof.

To attain this, the present invention generally comprises a game board apparatus and method of playing a game for improving mathematical skills that includes a game board having a top surface. The top surface has indicia forming a grid thereon and the grid includes a plurality of boxes for positioning one of a plurality of game pieces thereon. The plurality of boxes further includes blank boxes, symbol boxes, chance boxes and bonus boxes. The apparatus also includes a plurality of game tiles comprising number tiles, symbol tiles, and joker tiles and blank tiles. The number tiles have the digits 0 through 9 marked thereon, the symbol tiles have arithmetic symbols marked thereon, and the joker tiles have the word "joker" marked thereon so that the are for representing any symbol or number indicated by a player. The apparatus further includes a plurality of chance cards for use when a player moves a game tile onto a chance box. The chance cards have point and explanation indicia.

The method of playing the game to improve mathematical skills includes selecting a color of tiles by each of the players for identifying each tile placed on the game board by each different player. Then, the method includes dispensing a plurality of sets of game tiles to each player. The method further includes starting the game with each player having a preliminary score of 150 points. Further, the method includes placing a series of tiles by a first one of the players on the game board in an order forming an equation of whole numbers from the plurality of sets of game tiles on the top surface of the board. The equation is formed of whole numbers from 1 through 99 and is formed of less than twelve tiles. Further, the equation includes at least two symbol tiles with one of the symbol tiles having the "=" symbol indicated thereon. Also, the equation is formed along either a horizontal axis or a vertical axis of the game board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mathematical game apparatus and method of playing the same apparatus and method which has many of the advantages of the mathematical skills games mentioned heretofore and many novel features that result in a new mathematical game apparatus and method of playing the same which is not anticipated, rendered obvious, suggested, or even implied by any of the prior art mathematical skills games, either alone or in any combination thereof.

It is another object of the present invention to provide a new mathematical game apparatus and method of playing the same which may be easily and efficiently manufactured and marketed.

It is a further object of the present invention to provide a new mathematical game apparatus and method of playing the same which is of a durable and reliable construction.

An even further object of the present invention is to provide a new mathematical game apparatus and method of playing the same which is susceptible of a low cost of manufacture with regard to both materials and labor, and which accordingly is then susceptible of low prices of sale to the consuming public, thereby making such mathematical game apparatus and method of playing the same economically available to the buying public.

Still yet another object of the present invention is to provide a new mathematical game apparatus and method of playing the same which provides in the apparatuses and methods of the prior art some of the advantages thereof, while simultaneously overcoming some of the disadvantages normally associated therewith.

Still another object of the present invention is to provide a new mathematical game apparatus and method of playing the same for developing mathematical acuity.

Yet another object of the present invention is to provide a game board apparatus and method of playing a game for improving mathematical skills that includes a game board having a top surface. The top surface has indicia forming a grid thereon and the grid includes a plurality of boxes for positioning one of a plurality of game pieces thereon. The plurality of boxes further includes blank boxes, symbol boxes, chance boxes and bonus boxes. The apparatus also includes a plurality of game tiles comprising number tiles, symbol tiles, and joker tiles and blank tiles. The number tiles have the digits 0 through 9 marked thereon, the symbol tiles have arithmetic symbols marked thereon, and the joker tiles have the word "joker" marked thereon so that the are for representing any symbol or number indicated by a player. The apparatus further includes a plurality of chance cards for use when a player moves a game tile onto a chance box. The chance cards have point and explanation indicia.

The method of playing the game to improve mathematical skills includes selecting a color of tiles by each of the players for identifying each tile placed on the game board by each different player. Then, the method includes dispensing a plurality of sets of game tiles to each player. The method further includes starting the game with each player having a preliminary score of 150 points. Further, the method includes placing a series of tiles by a first one of the players on the game board in an order forming an equation of whole numbers from the plurality of sets of game tiles on the top surface of the board. The equation is formed of whole numbers from 1 through 99 and is formed of less than twelve tiles. Further, the equation includes at least two symbol tiles with one of the symbol tiles having the "=" symbol indicated thereon. Also, the equation is formed along either a horizontal axis or a vertical axis of the game board.

Still yet another object of the present invention is to provide a new mathematical game apparatus and method of playing the same that allows players to hone their basic mathematical skills, including the use of the order of operations.

Even still another object,of the present invention is to provide a new mathematical game apparatus and method of playing the same that provides an entertaining format in which to develop mathematical skills.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
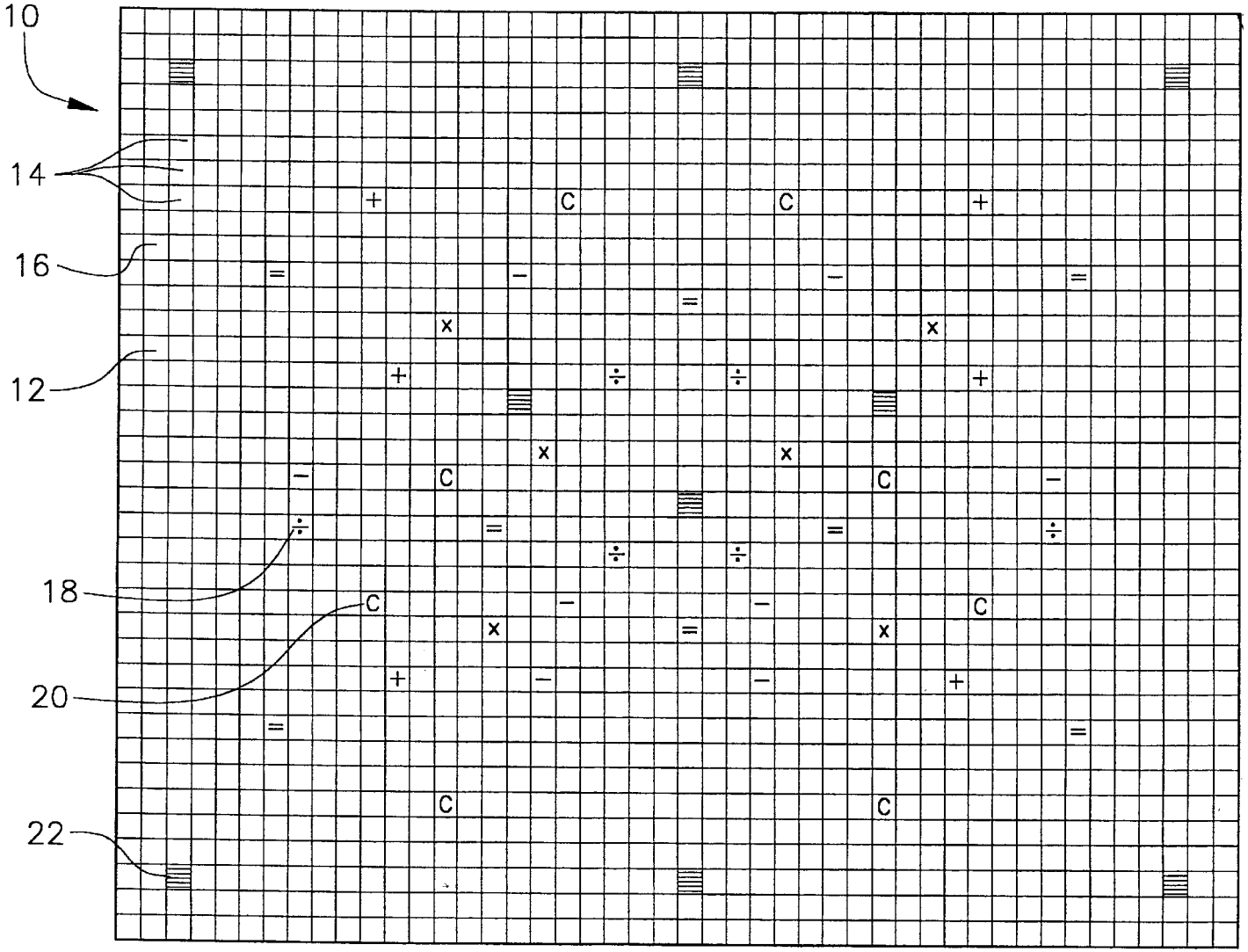
FIG. 1 is a schematic view of a new mathematical game board according to the present invention.
Figure 2:
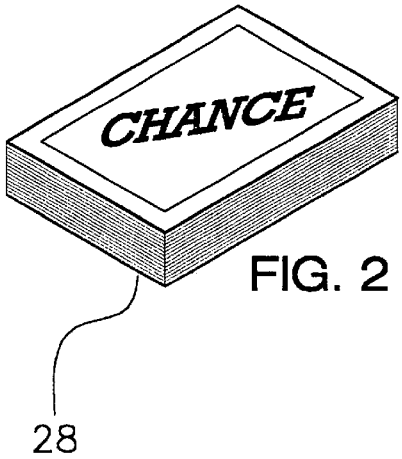
FIG. 2 is a schematic perspective view of the chance cards of the present invention.
Figure 3:
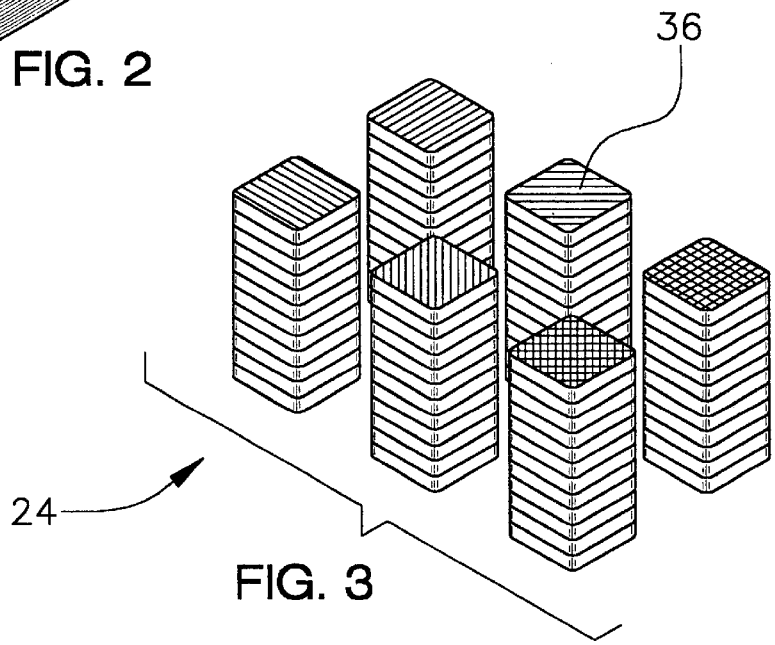
FIG. 3 is a schematic perspective view of the game tiles of the present invention.
Figure 4:
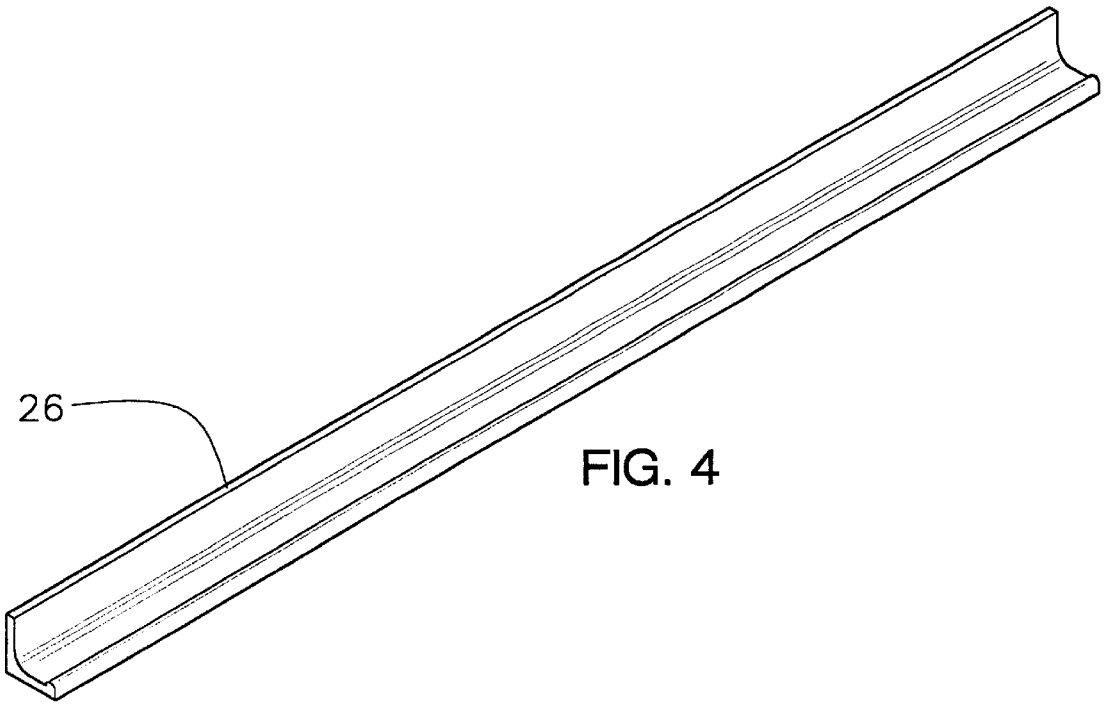
FIG. 4 is a schematic perspective view of a game tile rack of the present invention.
Figures 5, 6:
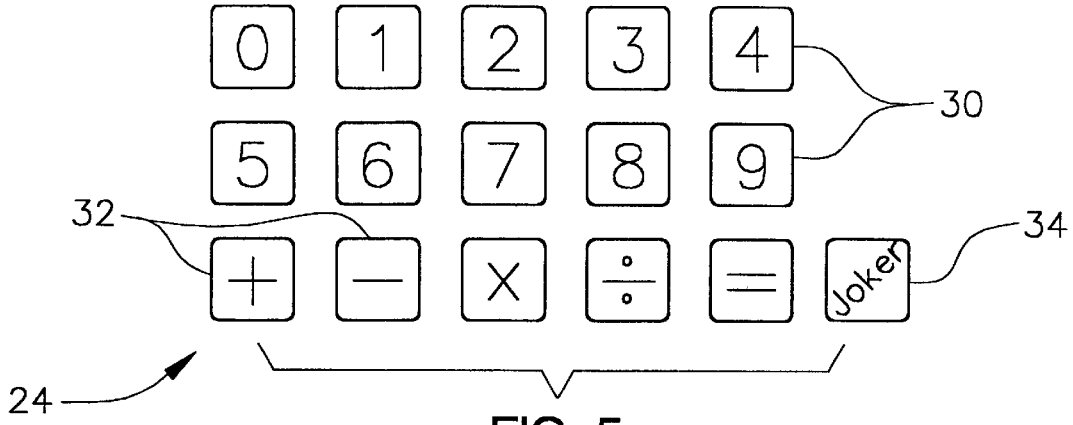
FIG. 5 is a schematic view of the number, symbol and joker faces of the game tiles of the present invention.
FIG. 6 is a schematic face view of the chance cards of the present invention.
Figure 7:
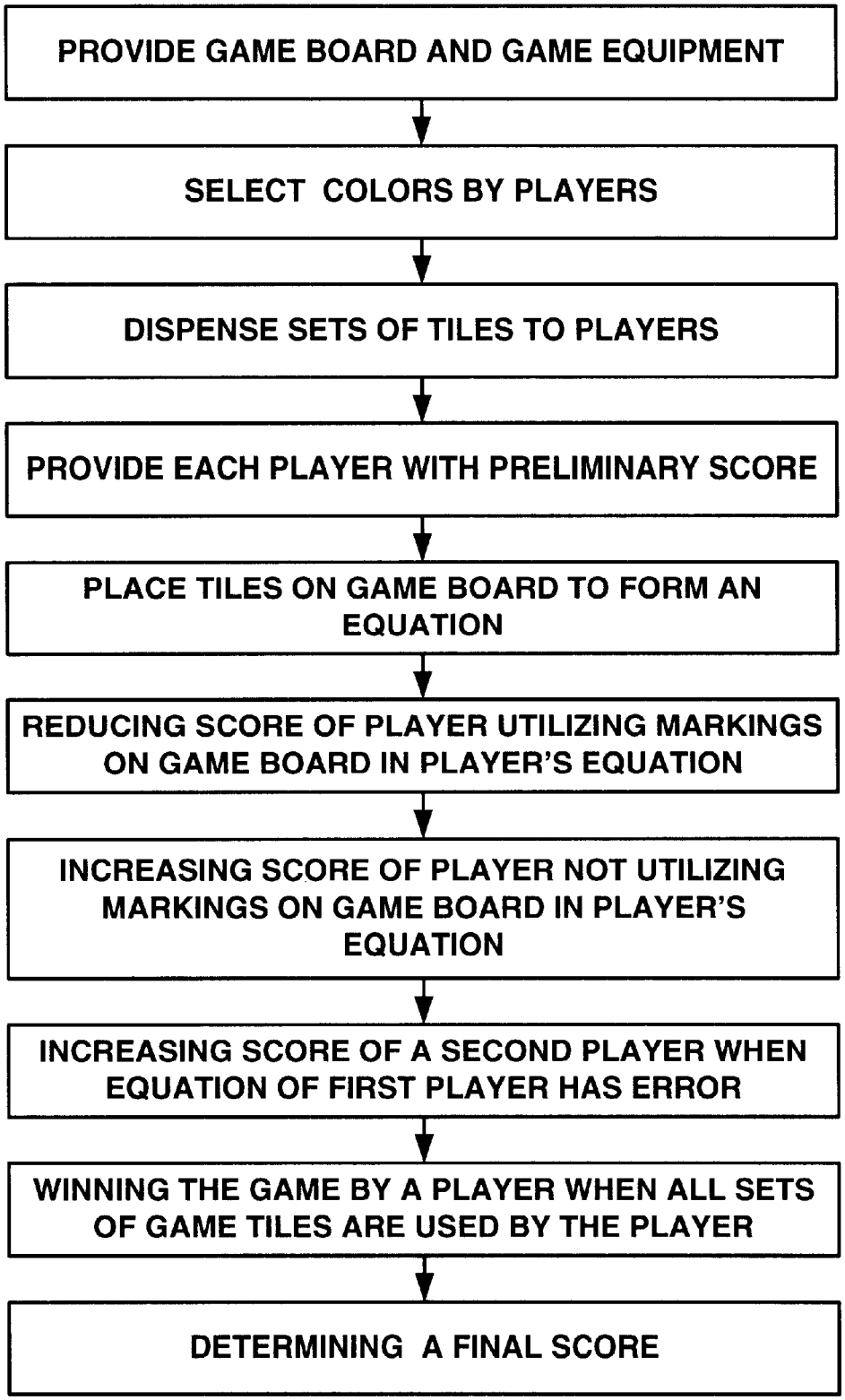
FIG. 7 is a schematic flow chart of the method of the present invention.

With reference now to the drawings, and in particular to FIGS. 1 through 7 thereof, a new mathematical game apparatus and method of playing the same embodying the principles and concepts of the present invention and generally designated by the reference numeral 10 will be described.

As best illustrated in FIGS. 1 through 7, the mathematical game apparatus and method of playing the game for improving mathematical skills 10. The invention includes a game board having a top surface with indicia forming a grid thereon. The grid includes a plurality of boxes for positioning one of a plurality of game pieces thereon. The plurality of boxes further includes blank boxes, symbol boxes, chance boxes and bonus boxes. The symbol boxes may have indicia marked resembling an arithmetic symbol thereon. The chance boxes have indicia thereon resembling the letter C, and the bonus boxes may be a blue color.

The invention further includes a plurality of game tiles that include number tiles, symbol tiles, and joker tiles and blank tiles. The number tiles may have the digits 0 through 9 marked thereon, the symbol tiles may have arithmetic symbols marked thereon, and the joker tiles may have the word "joker" marked thereon. Preferably, the joker tile represents any symbol or number indicated by a player. Ideally, the game tiles are a plurality of colors for distinguishing tiles for use by one player from tiles for use by another player and the blank tiles may be used for covering a tile that is in use on the game board.

The apparatus may also include a plurality of game tile racks for display of the tiles to the player when the tiles are not placed on the game board. Ideally, this rack permits the user to store her tiles in a way to allow her to practice forming equations on her tile rack prior to placing them on the board.

The apparatus may also include a plurality of chance cards for use when a player moves a game tile onto a chance box. The chance cards have point and explanation indicia such that the plurality of chance cards additionally comprise 42 chance cards. Ideally, 21 of the chance cards preferably have point values for deducting from a player's score and 21 of the chance cards have point values for increasing a, player's score.

The method of playing the game may be practiced by a plurality of players and includes placing a series of the game tiles upon the game board in an order that resembles mathematical equations. Preferably, each of the players selects a color of tiles for identifying each tile placed on the game board by each different player.

The method further includes the step of dispensing a plurality of sets of game tiles to each player. Ideally, each of the sets includes 104 game tiles, and each player receives the following breakdown of the 104 tiles. Each player may receive 5 sets of 7 tiles whereby each set has one of the numbers 1, 2 5, 6 and 7 indicated thereon. Each player may receive 4 sets of 6 tiles, whereby each set has one of the numbers 3, 4, 8, 9 indicated thereon. Each player may receive 1 set of 8 tiles having the number 0 indicated thereon. Further, each player may receive 4 sets of 6 tiles, whereby each set has one of the symbols "÷","×", "+" "−" indicated thereon. Further, each player may receive 1 set of 10 tiles, whereby each tile has the symbol "=" indicated thereon. Further, each player may receive 1 set of 3 tiles, whereby each tile has the word "joker" indicated thereon.

Ideally, each player starts the game with a preliminary score of 150 points. This preliminary score, however, may be adjusted according to predetermined actions as set forth in this description. To play, a first one of the players places a series of tiles on the top surface of the game board in an order forming an equation of whole numbers from the plurality of sets of game tiles. Preferably, the equation is formed of whole numbers from 1 through 99 and the equation may be formed of less than twelve tiles. The equation may include at least two symbol tiles with one of the symbol tiles having the "=" symbol indicated thereon. Preferably, the equation is formed along a horizontal axis or a vertical axis of the game board.

Ideally, the score may be adjusted by the types of actions described herein. The preliminary score may be reduced by a predetermined amount when a portion of the top surface covered by one of the series of tiles of the equation is a blue box. Ideally, the predetermined amount has a value of 20 points. The preliminary score may be reduced by a predetermined amount when the equation includes one of the symbol boxes. Ideally, this predetermined amount has a value of 20 points. Further, the player must place a coordinating symbol tile with a corresponding symbol upon the top surface of the symbol box.

Ideally, the preliminary score may be increased by a predetermined amount when the equation does not include one of the symbol boxes and ideally, the predetermined amount has a value of 30 points. Also, the player may place any tile other than a corresponding symbol tile upon a corresponding symbol located along the top surface of the symbol box.

The method of playing the game may further include drawing a chance card from the plurality of chance cards when one of the tiles forming the equation covers one of the chance boxes and may also include adjusting the score by an amount indicated on the chance card. Also, the preliminary score of another player may be increased by a predetermined amount when the equation of the player is incorrect and the mathematical error is noticed by other player. Preferably, the predetermined amount has a value of 20 points.

The preliminary score may be increased by a predetermined amount when the equation of the player places a symbol tile adjacent to a symbol box on the board. Ideally, this predetermined amount has a value of 10 points.

Further, the method of playing the game includes winning the game by using all of the sets of game tiles given to a player at the beginning of game. Also, a final score may be determined by adding predetermined point values for each of the remaining tiles to the score. In one embodiment of the invention, the predetermined amounts may be 50 points for joker tiles, 20 points for all symbol tiles, 5 points for all number tiles have 0, 1, 2, 3, 4 indicated thereon, and 10 points for all number tiles have 5, 6, 7, 8, 9 indicated thereon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since mathematical game apparatus and method of playing the same as modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A game for improving mathematical skills comprising:

a game board having a top surface, said top surface having indicia forming a grid thereon, said grid comprising a plurality of boxes for positioning one of a plurality of game pieces thereon, said plurality of boxes further comprising blank boxes, symbol boxes, chance boxes and bonus boxes;

a plurality of game tiles comprising number tiles, symbol tiles, and joker tiles and blank tiles, said number tiles having the digits 0 through 9 marked thereon, said symbol tiles having arithmetic symbols marked thereon, said joker tiles having the word "joker" marked thereon and for representing any symbol or number indicated by a player; and a plurality of chance cards for use when a player moves a game tile onto a chance box, said chance cards having point and explanation indicia.

2. The game as described in claim 1, wherein said symbol boxes have indicia marked resembling an arithmetic symbol thereon, said chance boxes have indicia thereon resembling the letter C, and said bonus boxes have a blue color.

3. The game as described in claim 1, wherein said game tiles have a plurality of colors for distinguishing tiles for use by one player from tiles for use by another player, said blank tiles being for covering a tile that is in use on said game board.

4. The game as described in claim 1, further comprising a plurality of game tile racks for display of said tiles to said player when said tiles are not placed on said game board.

5. The game as described in claim 1, wherein said plurality of chance cards comprises 42 chance cards, 21 of said chance cards having point values for deducting from a player's score, 21 of said chance cards having point values for increasing a player's score.

6. A method of playing a game for improving mathematical skills comprising the steps of:

providing a game board having a top surface, said top surface having indicia forming a grid thereon, said grid comprising a plurality of boxes for positioning one of a plurality of game pieces thereon, said plurality of boxes further comprising blank boxes, symbol boxes, chance boxes and bonus boxes;

a plurality of game tiles comprising number tiles, symbol tiles, and joker tiles and blank tiles, said number tiles having the digits 0 through 9 marked thereon, said symbol tiles having arithmetic symbols marked thereon, said joker tiles having the word "joker" marked thereon and for representing any symbol or number indicated by a player; and a plurality of chance cards for use when a player moves a game tile onto a chance box, said chance cards having point and explanation indicia;

selecting a color of tiles by each of said players for identifying each tile placed on said game board by each different player;

dispensing a plurality of sets of game tiles to each player;

starting said game by each player having a preliminary score of 150 points;

placing a series of tiles by a first one of the players on said game board in an order forming an equation of whole numbers from said plurality of sets of game tiles on said top surface of said board, said equation being formed of whole numbers from 1 through 99, said equation being formed of less than twelve tiles, said equation including at least two symbol tiles with one of said symbol tiles having the "=" symbol indicated thereon,.said equation being formed along a horizontal axis or a vertical axis of said game board.

7. The method of claim 6, wherein said step of dispensing a plurality of sets of game tiles to each player further includes forming each of said sets with 104 game tiles, each player receiving 5 first sets of 7 tiles, each first set having one of the numbers 1, 2, 5, 6 and 7 indicated thereon, each player receiving 4 second sets of 6 tiles, each second set having one of the numbers 3, 4, 8, 9 indicated thereon, each player receiving 1 third set of 8 tiles, each tile of the third set having the number 0 indicated thereon, each player receiving 4 fourth sets of 6 tiles, each fourth set having one of the symbols "÷", "×", "+" "−" indicated thereon, each player receiving 1 fifth set of 10 tiles, each tile of the fifth set having the symbol "=" indicated thereon, and each player receiving 1 sixth set of 3 tiles, each tile of the sixth set having the word "joker" indicated thereon.

8. The method of claim 6, wherein said preliminary score is reduced by a predetermined amount when a portion of said top surface covered by one of said series of tiles of said equation is a blue box.

9. The method of claim 8, wherein said predetermined amount has a value of 20 points.

10. The method of claim 9, wherein said predetermined amount has a value of 20 points.

11. The method of claim 6, wherein said step of providing a preliminary score further includes reducing said preliminary score by a predetermined amount when said equation includes one of said symbol boxes and said player placing a coordinating symbol tile with a corresponding symbol upon said top surface of said symbol box.

12. The method of claim 11, wherein said predetermined amount has a value of 30 points.

13. The method of claim 12, wherein said predetermined amount has a value of 10 points.

14. The method of claim 6, wherein said step of providing a preliminary score further includes increasing said preliminary score by a predetermined amount when said equation does not include one of said symbol boxes and said player placing any tile other than a corresponding symbol tile upon a corresponding symbol upon said top surface of said symbol box.

15. The method of claim 14, wherein said predetermined amount has a value of 20 points.

16. The method of claim 6, additionally comprising the step of drawing a chance card from said plurality of chance cards when one of said tiles forming said equation covers one of said chance boxes and adjusting said score by an amount indicated on said chance card.

17. The method of claim 6, wherein said step of providing a preliminary score further includes increasing said preliminary score of a second player by a predetermined amount when said equation of said first player is incorrect and said mathematical error is noticed by said second player.

18. The method of claim 6, wherein said step of providing a preliminary score further includes increasing said preliminary score by a predetermined amount when said equation of said player positions a symbol tile adjacent to a symbol box on said board.

19. The method of claim 6, further including the step of winning said game by using all game tiles of said sets of game tiles given to a player at the beginning of game and determining a final score, said final score being determined by adding predetermined point values for each of any remaining tiles to said score, said predetermined point values being 50 points for joker tiles, 20 points for all symbol tiles, 5 points for all number tiles having 0, 1, 2, 3, 4 indicated thereon, and 10 points for all number tiles having 5, 6, 7, 8, 9 indicated thereon.

20. A method of playing a game for improving mathematical skills comprising the steps of:

providing a game board having a top surface, said top surface having indicia forming a grid thereon, said grid comprising a plurality of boxes for positioning one of a plurality of game pieces thereon, said plurality of boxes further comprising blank boxes, symbol boxes, chance boxes and bonus boxes, said symbol boxes having indicia marked resembling an arithmetic symbol thereon, said chance boxes having indicia thereon resembling the letter C, said bonus boxes having a blue color, providing a plurality of game tiles comprising number tiles, symbol tiles, and joker tiles and blank tiles, said number tiles having the digits 0 through 9 marked thereon, said symbol tiles having arithmetic symbols marked thereon, said joker tiles having the word "joker" marked thereon, said joker tile being for representing any symbol or number indicated by a player, said game tiles having a plurality of colors for distinguishing tiles for use by one player from tiles for use by another player, said blank tiles being for covering a tile that is in use on said game board;

providing a plurality of game tile racks for display of said tiles to said player when said tiles are not placed on said game board;

providing a plurality of chance cards for use when a player moves a game tile onto a chance box, said chance cards having point and explanation indicia, wherein said plurality of chance cards additionally comprises 42 chance cards, 21 of said chance cards having point values for deducting from a player's score, 21 of said chance cards having point values for increasing a player's score;

providing a plurality of players for placing a series of said game tiles upon said game board in an order for resembling mathematical equations;

selecting a color of tiles by each of said players for identifying which player placed tiles of a color on said game board;

dispensing a plurality of sets of game tiles to each player, each of said sets comprising 104 game tiles, each player receiving 5 sets of 7 tiles, each set having one of the numbers 1, 2, 5, 6 and 7 indicated thereon, each player receiving 4 sets of 6 tiles, each set having one of the numbers 3, 4, 8, 9 indicated thereon, each player receiving 1 set of 8 tiles having the number 0 indicated thereon, each player receiving 4 sets of 6 tiles, each set having one of the symbols "÷", "×", "+" "−" indicated thereon, each player receiving 1 set of 10 tiles, each tile having the symbol "=" indicated thereon, and each player receiving 1 set of 3 tiles, each tile having the word "joker" indicated thereon;

starting said game by each player having a preliminary score of 150 points;

placing by a first one of the players a series of tiles on said game board in an order forming an equation of whole numbers from said plurality of sets of game tiles on said top surface of said board, said equation being formed of whole numbers from 1 through 99, said equation being formed of less than twelve tiles, said equation including at least two symbol tiles with one of said symbol tiles having the "=" symbol indicated thereon, said equation being formed along a horizontal axis or a vertical axis of said game board;

reducing said preliminary score of said first player by a predetermined amount when a portion of said top surface covered by one of said series of tiles of said equation is a blue box, said predetermined amount having a value of 20 points;

reducing said preliminary score of said first player by a predetermined amount when said equation includes one of said symbol boxes, said predetermined amount having a value of 20 points, said player placing a coordinating symbol tile with a corresponding symbol upon said top surface of said symbol box;

increasing said preliminary score of said first player by a predetermined amount when said equation does not include one of said symbol boxes, said predetermined amount having a value of 30 points, said player any tile other than a corresponding symbol tile upon a corresponding symbol upon said top surface of said symbol box;

drawing a chance card from said plurality of chance cards when one of said tiles forming said equation covers one of said chance boxes and adjusting said score by an amount indicated on said chance card;

increasing said preliminary score of a second player by a predetermined amount when said equation of said first player is incorrect and said mathematical error is noticed by second player, said predetermined amount having a value of 20 points;

increasing said preliminary score of said first player by a predetermined amount when said equation of said first player places a symbol tile adjacent to a symbol box on said board, said predetermined amount having a value of 10 points;

winning said game by using all of said sets of game tiles given to a player at the beginning of game; and determining a final score by said first player by adding predetermined point values for each of said remaining tiles to said score, said predetermined amounts being 50 points for joker tiles, 20 points for all symbol tiles, 5 points for all number tiles having 0, 1, 2, 3, 4 indicated thereon, and 10 points for all number tiles having 5, 6, 7, 8, 9 indicated thereon.

* * * * *